US011965517B1

(12) United States Patent
Hong et al.

(10) Patent No.: US 11,965,517 B1
(45) Date of Patent: Apr. 23, 2024

(54) COOLING FAN MODULE

(71) Applicant: Brose Fahrzeugteile SE & Co. Kommanditgesellschaft, Würzburg, Würzburg (DE)

(72) Inventors: Tao Hong, Farmington Hills, MI (US); Attila Simofi-Ilyes, Clarkston, MI (US); Christopher Kosek, Lasalle (CA); John Fleck, Holly, MI (US)

(73) Assignee: Brose Fahrzeugteile SE & Co. Kommanditgesellschaft, Würzburg (DE)

( * ) Notice: Subject to any disclaimer, the term of this patent is extended or adjusted under 35 U.S.C. 154(b) by 0 days.

(21) Appl. No.: 18/216,930

(22) Filed: Jun. 30, 2023

(51) Int. Cl.

| | |
|---|---|
| ***F01P 7/10*** | (2006.01) |
| ***F04D 19/00*** | (2006.01) |
| ***F04D 29/32*** | (2006.01) |
| ***F04D 29/38*** | (2006.01) |

(52) U.S. Cl.
CPC ..... *F04D 19/002* (2013.01); *F04D 29/326* (2013.01); *F04D 29/329* (2013.01); *F04D 29/38* (2013.01)

(58) Field of Classification Search
CPC .... F04D 29/164; F04D 29/326; F04D 29/526; F04D 19/002; F04D 29/663
USPC ..... 123/41.49
See application file for complete search history.

(56) References Cited

U.S. PATENT DOCUMENTS

| | | | | |
|---|---|---|---|---|
| 3,814,538 | A * | 6/1974 | Sjoqvist | F04D 29/403 415/222 |
| 9,180,772 | B2 * | 11/2015 | Durello | F04D 29/325 |
| 10,072,670 | B2 * | 9/2018 | Jung | F04D 19/002 |
| 10,267,209 | B2 * | 4/2019 | Kim | F01P 5/06 |
| 11,028,858 | B2 | 6/2021 | Hong et al. | |
| 2004/0156712 | A1 * | 8/2004 | Nadeau | F04D 29/164 415/174.5 |
| 2006/0216147 | A1 * | 9/2006 | Park | F04D 29/667 415/220 |

* cited by examiner

*Primary Examiner* — Long T Tran
*Assistant Examiner* — James J Kim
(74) *Attorney, Agent, or Firm* — Dickinson Wright PLLC

(57) ABSTRACT

A cooling fan module may include a fan assembly and a shroud. The fan assembly including a number of fan blades and the shroud including a first sidewall and a first ring. The first sidewall defining an opening and the first ring extending in an axial direction from the first sidewall. The first ring including an inner periphery provided with a number of first serrations, each serration of the number of first serrations extending in a radial direction. The radial direction is substantially orthogonal to the axial direction.

20 Claims, 8 Drawing Sheets

COOLING FAN MODULE

TECHNICAL FIELD

The present disclosure relates to a cooling fan module, in particular one for use with a heat exchanger, such as a radiator, for an automotive vehicle. However, the present disclosure can also be used in other applications such as cooling fan for a home heating and cooling system.

BACKGROUND

Vehicles often include various components that are cooled by a heat exchanger, such as a radiator. Heated air may be drawn or moved away from the radiator by a cooling fan module. Cooling fan modules may include a powered fan that is housed within a frame and operable to move air from an upstream side of the frame to a downstream side of the frame.

SUMMARY

According to one embodiment, a cooling fan module assembly is provided. The cooling fan module assembly may include a fan assembly, a motor, and a shroud. The motor is configured to be coupled to the fan assembly. The shroud may include a sidewall that may define an aperture configured to receive the fan assembly and the motor. The motor may be configured to rotate the fan assembly to route air from an upstream side of the shroud to a downstream side of the shroud. The shroud may include a first ring that may extend in an axial direction from the first sidewall and may include an axial face. The axial face of the first ring may include a number of first axial serrations. The number of first axial serrations may extend in a radial direction, the radial direction substantially orthogonal to the axial direction, so that a distal end of each serration of the number of first axial serrations faces the fan assembly.

In one or more embodiments, the fan assembly may include a fan ring that may connect distal ends of each of the fan blades to one another. As an example, the fan ring may include a first leg that may extend in an axial direction, a second leg that may extend in a radial direction, and a connecting portion (e.g., a curved portion) that may extend between the first and second legs.

According to another embodiment, a shroud for use in a cooling fan module is provided. The shroud may include a sidewall which may define an opening configured to receive a fan assembly and a motor. The motor may be configured to rotate the fan assembly to route air from an upstream side of the sidewall to a downstream side of the sidewall. The shroud may also include a barrel that may extend from the sidewall, the barrel may extend from the sidewall and form an inner periphery of the opening. The barrel may include at least one of a number of first circumferential and radial serrations and at least one of a number of second circumferential and radial serrations. As an example, the second number of radial and circumferential serrations may be radially and inwardly spaced apart from the number of first radial and circumferential serrations.

According to yet another embodiment, a cooling fan module is provided. The cooling fan module may include a fan assembly and a shroud. The fan assembly may include a number of fan blades and the shroud may include a sidewall and a barrel extending therefrom. The barrel may include a first ring and a second ring. The first ring may include a first inner peripheral surface, and the second ring may include a second inner peripheral surface. The first and second inner peripheral surfaces each including a number of surface discontinuities. The number of surface discontinuities may be collectively configured to generate turbulent airflow within the barrel to mitigate air flow from moving from the downstream side to the upstream side.

BRIEF DESCRIPTION OF THE DRAWINGS

FIG. 1-A illustrates a partial-perspective-cross-sectional view of the cooling fan module taken along the lines 1-A in FIG. 1.

DETAILED DESCRIPTION

Figure 1:
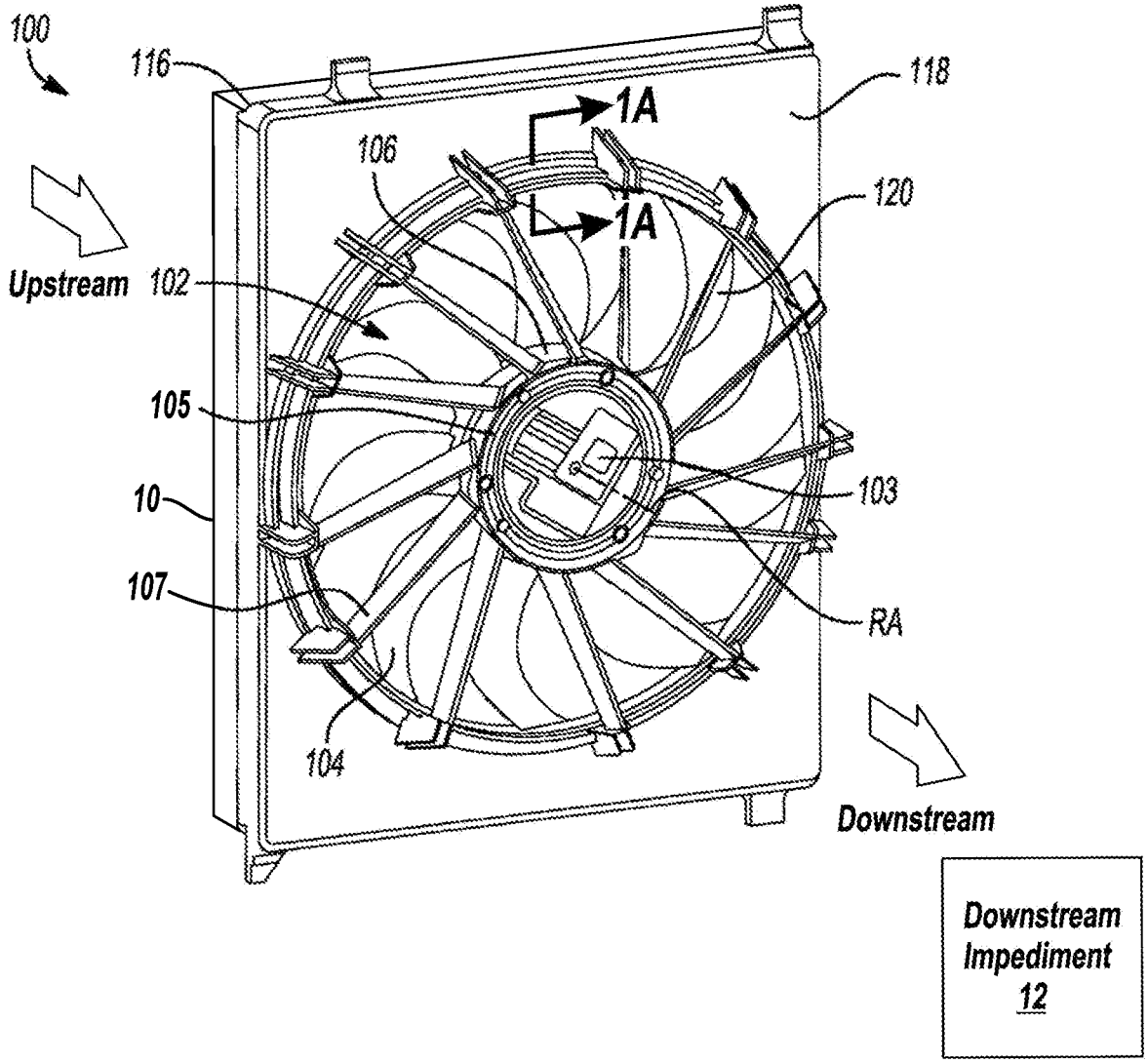
FIG. 1 illustrates a perspective view of an exemplary cooling fan module as viewed from a downstream side of the cooling fan module.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" may include any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Generally, cooling systems include a heat exchanger, such as a radiator and a cooling fan module that is configured to move or displace air from the heat exchanger to in a downstream direction. As one example, the heat exchanger may be a radiator or a condenser that transfers heat from a liquid coolant or refrigerant to an airstream. The heat source may be an internal combustion engine or an electric motor or other heat generating source. The side of the cooling fan module disposed closest to the radiator may be referred to as the upstream side and the side disposed further away from the radiator may be referred to as the downstream side. In one or more embodiments, the downstream impediment may be an internal combustion engine, an electric machine or motor, one or more batteries, or another vehicle component.

Under certain conditions, such as when the fan is in the normal operating range, the pressure downstream from the fan may be higher than pressure on the upstream side of the fan. This pressure difference drives recirculating airflow from the downstream side back to the upstream side through a gap between the fan tips or fan ring and the opening defined by the frame. This recirculating airflow decreases efficiency and leading to unwanted noise. An example of a known cooling fan module which includes an integrated downstream funnel configured to prevent or at least reduce such recirculating air flow is provided in U.S. Pat. No. 11,028,858 B2 and is hereby incorporated by reference in its entirety.

Figure 1A:
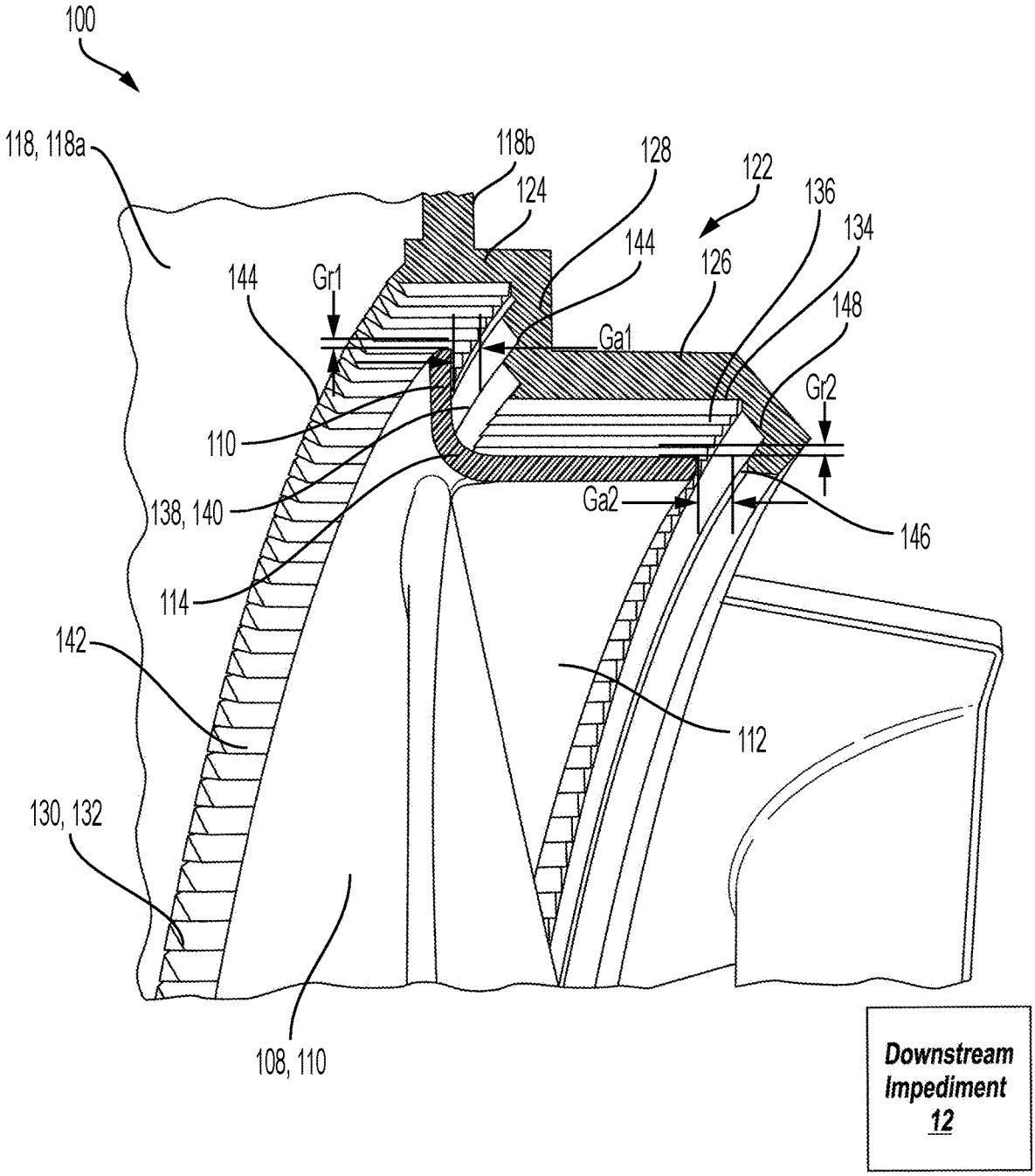
Figure 2:
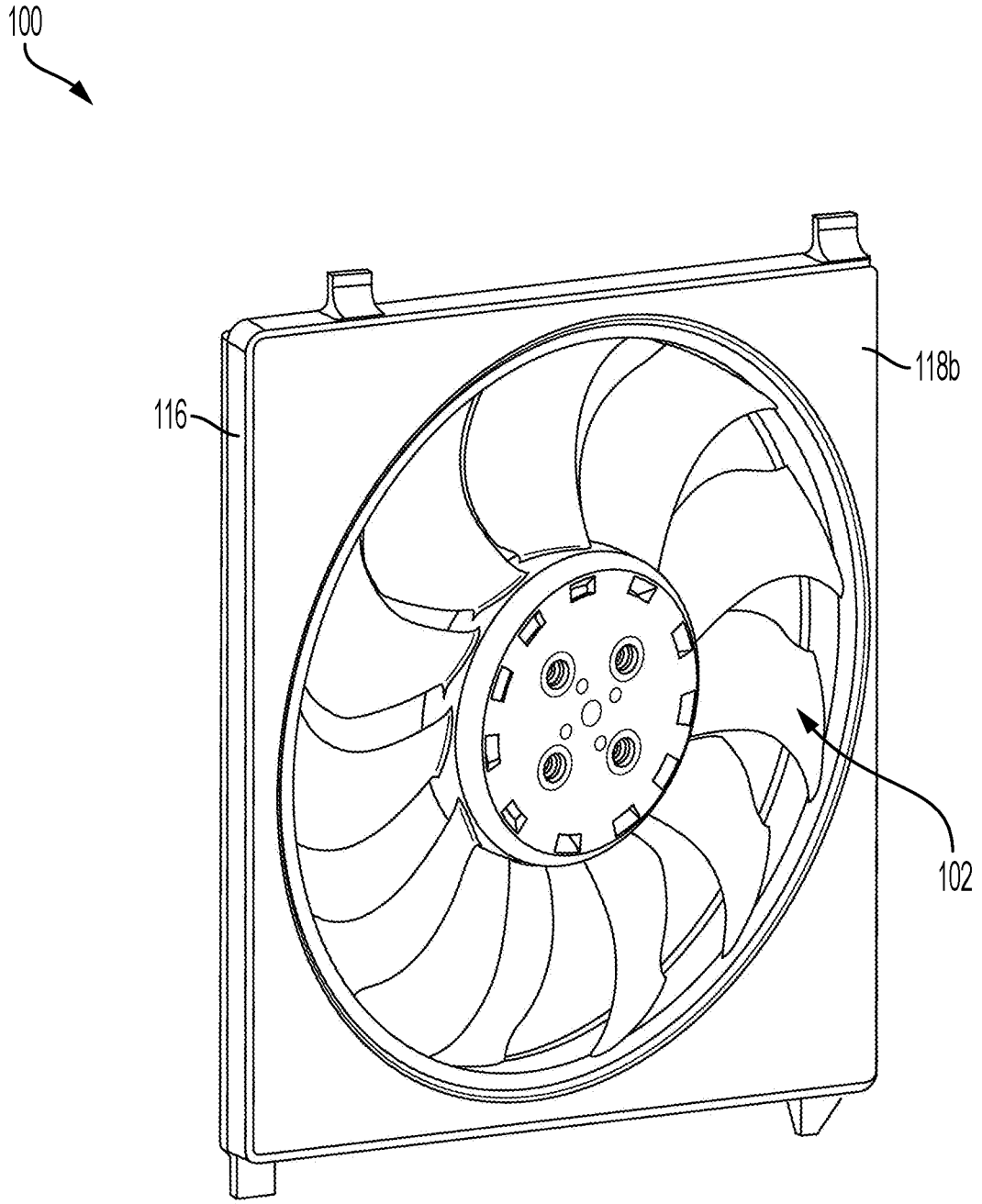
FIG. 2 illustrates a perspective view of the exemplary cooling fan module illustrated in FIG. 1 as viewed from an upstream side of the cooling fan module.

FIG. 1 illustrates a perspective view of a vehicle thermal management system provided with a cooling fan module 100 and FIG. 1A illustrates a cross-sectional-perspective view of a portion of the cooling fan module 100 taken along the lines 1A in FIG. 1. FIG. 1 depicts the cooling fan module 100 from the downstream side and FIG. 2 depicts the cooling fan module 100 from the upstream side. The cooling fan module 100 may be configured to move or displace air from a heat exchanger 10 towards a downstream impediment 12. As one example, the heat exchanger 10 may be a radiator or a condenser that may use liquid such as coolant that cools incoming air. The heat source may be an internal combustion engine or an electric motor or other heat generating source. The side of the cooling fan module disposed closest to the radiator may be referred to as the upstream side and the side disposed further away from the radiator may be referred to as the downstream side. In one or more embodiments, the downstream impediment 12 may be an internal combustion engine, an electric machine or motor, one or more batteries, or another vehicle component.

The cooling fan module 100 may be provided with a fan assembly 102 that may include a number of fan blades 104 that may extend from a hub 106 and terminate at a fan ring 108. As one example, the fan assembly 102 may be driven by an electric motor 103 to rotate the fan assembly 102 about a rotational axis RA that may be defined by the hub 106, and configured to move air from the upstream side to the downstream side. The fan ring 108 may include a first leg 110 and a second leg 112 that may extend in a direction that is orthogonal to the first leg 110. The first leg 110 and the second leg 112 may be connected to one another by a curved portion 114. The motor 103 may be supported by a motor mounting ring 105 which may be supported by one or more struts 107 extending from the shroud sidewall 118.

The cooling fan module 100 may include a shroud 116 that may include a first sidewall 118 that may define an opening 120 and the fan assembly 102 may be disposed within the opening 120. The shroud 116 may also be provided with a barrel 122 configured to guide air pushed by the fan assembly 102 towards the downstream side or downstream impediment 12. As will be described in greater detail below, one or more portions of the barrel may be configured to generate a turbulent air flow within the barrel to reduce air flow recirculating from the downstream side to the upstream side.

In one or more embodiments, the barrel 122 may include a first ring 124 that may be arranged about or form a circumference of the opening 120 and extend in an axial direction from a first side 118*a* and a second side 118*b* of the sidewall 118. The barrel 122 may also include a second ring 126 and a connection portion or sidewall 128 extending between the first and second rings 124. While the sidewall 128 is specifically identified as separate from the first ring 124 and the second ring 126, it is readily contemplated that the sidewall 128 may form a portion of the first ring 124. In one or more embodiments, the barrel 122 includes a second ring 126 that may be arranged coaxially with respect to the first ring 124 so that the barrel 122 tapers from the upstream side of the shroud 116 to the downstream side of the shroud 116. The sidewall 128 may extend between the first and second rings 124, 126. One or more inner peripheral surfaces of the barrel 122 may include a number of surface discontinuities that may generate turbulent air flow within the barrel to mitigate air flow from moving from the downstream side to the upstream side.

For example, the first ring 124 may include a first inner peripheral surface 130 provided with a first number of surface discontinuities 132, and the second ring 126 may include a second inner peripheral surface 134 that may be provided with a second number of surface discontinuities 136. Additionally or alternatively, a portion of the sidewall 128 (e.g., an axial face 138 which may be arranged to face the upstream side) may include a third number of surface discontinuities 140. In one or more embodiments, the sidewall 128, the third number of surface discontinuities 140, or both may be arranged to extend in a radial direction, such as substantially parallel to the first sidewall 118 of the shroud 116. The number of surface discontinuities 132, 134, 140 may be formed by a number of serrations or teeth that may form one or more peaks 142 and a number of recesses 144.

As an example, the first number of surface discontinuities 132 and the second number of surface discontinuities 136 may each be arranged to face the radial direction and, as such, the first and second number of surface discontinuities 132, 136 may be referred to as a first number of radial serrations 132 and a second number of radial serrations 136, respectively. Additionally or alternatively, the third number of surface discontinuities 140, which may be arranged to face the axial direction, may be referred to as a first number of axial serrations. In one or more embodiments, a distal portion of the second ring 126 may include an inner axial recess 148 disposed adjacent to the inner axial edge 146 to form a fourth number of surface discontinuities 150, which may also be referred to as a second number of axial serrations 150.

Portions of the fan ring 108 may be positioned with respect to the barrel 122 for optimum flow efficiency and acoustic performance while accounting for manufacturing tolerances to prevent the fan ring 108 from colliding with the barrel 122 as the fan assembly 102 rotates. For example, the first leg 110 may be radially spaced apart from a peak 142 of the first number of surface discontinuities 132 to form a first radial gap Gr1 and the second leg 112 may be radially spaced apart from a peak 142*a* of the second number of discontinuities 136 to form a second radial gap Gr2. The first radial gap Gr1 and the second radial gap Gr2 may be substantially equal to one another. The first leg 110 of the fan ring 108 may be axially spaced apart from a peak 142 of the third number of surface discontinuities 140 to form a first axial gap Ga1 and the second leg 112 may be spaced apart from an inner axial edge 146 of the second ring 126 to form a second axial gap Ga2. In one or more embodiments, the second axial gap Ga2 may be substantially equal to the first axial gap Ga2 and each of the first and second axial gaps Ga1, Ga2 may be greater than the first and second radial gaps Gr1, Gr2.

As an example, the shroud 116 may be formed of one or more polymeric materials, including but not limited to PP LGF 30 to PA 6.6/PA 6 SGF 30 and PP SGF. Because of the glass-filled fibers, the surface discontinuities may include a draft to prevent a die lock condition during the injection molding process of the shroud 116. Alternatively, the injection mold tool may include stripper plate to facilitate ejection of the molded part from the injection mold die.

Figure 3:
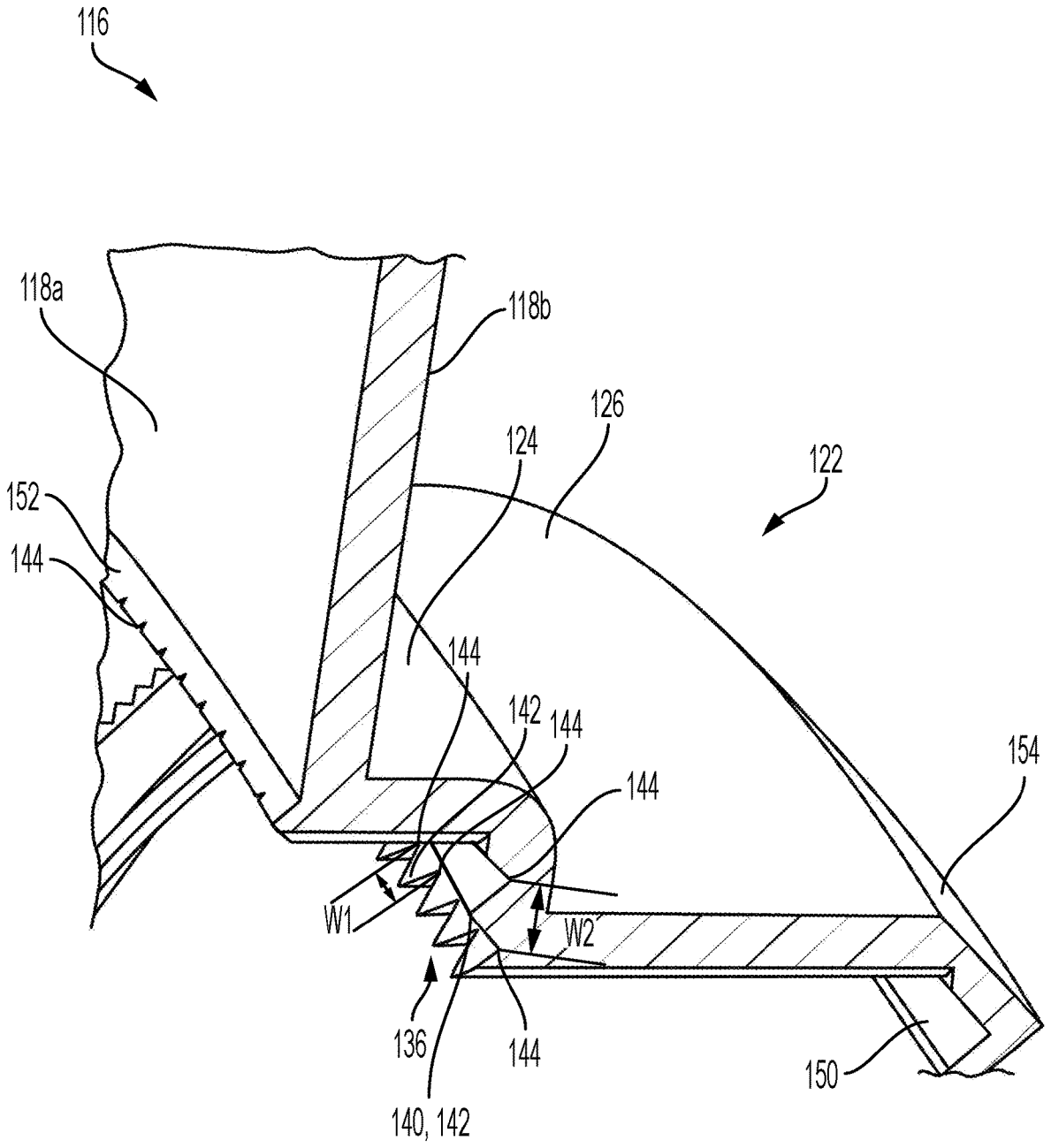
FIG. 3 illustrates a partial-perspective-cross-sectional view of a portion of the shroud of the cooling fan module.

FIG. 3 illustrates a partial-cross-sectional view of a portion of the shroud 116 according to one or more embodiments. FIG. 4 illustrates a partial cross-sectional view of a portion of the shroud 116 according to one or more embodiments. FIG. 5 illustrates a partial plan view of a portion of the shroud 116 according to one or more embodiments and FIG. 5A illustrates a detail view take along line A in FIG. 5.

As mentioned above, the radial serrations 132, 136 and axial serrations 140, 150 may be formed by a number of peaks 142 and recessed portions 144 that may be interstitially disposed between each of the peaks 142. In one or more embodiments, one or more of the radial serrations 132, 134 and axial serrations 140, 150 may have the shape of a triangular prism, though other suitable three-dimensional shapes are readily contemplated herein. Referring specifically to FIG. 3, a straight line distance extending between the recesses 144 disposed on either side of a peak may be referred to as a base. The width of the base and/or cross-sectional area of each serration of the number of serrations may vary. As an example, the second number of radial serrations 136 may have a base provided with a first width W1 and the first number of axial serrations 140 may have a base provided with a second width W2 that may be greater than the first width W1.

Figure 4A:
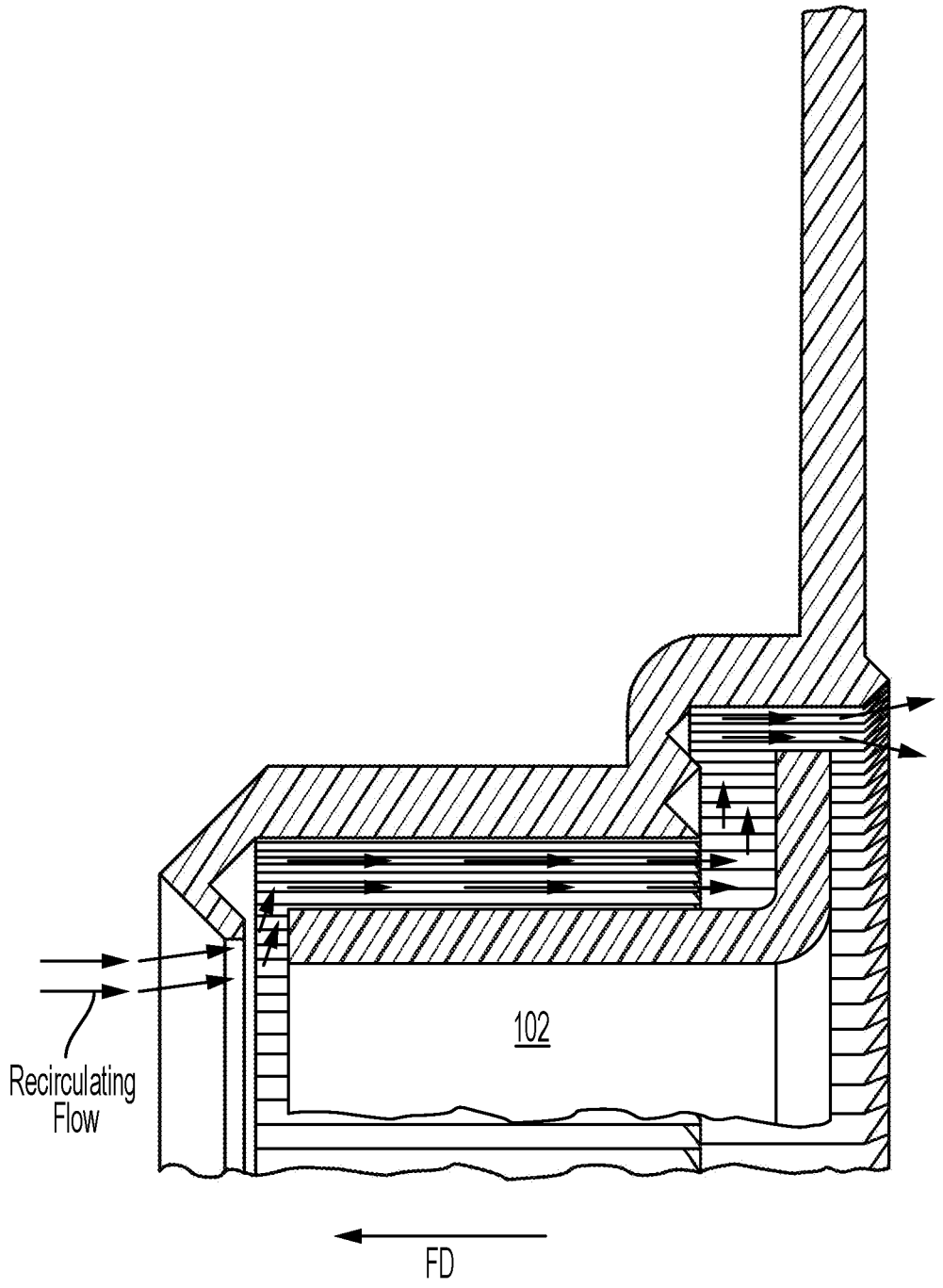
FIG. 4A illustrates a partial-cross-sectional view of a portion of the shroud and fan assembly illustrated in FIGS. 1-3 as well as the air passage of recirculating air.
Figure 4B:
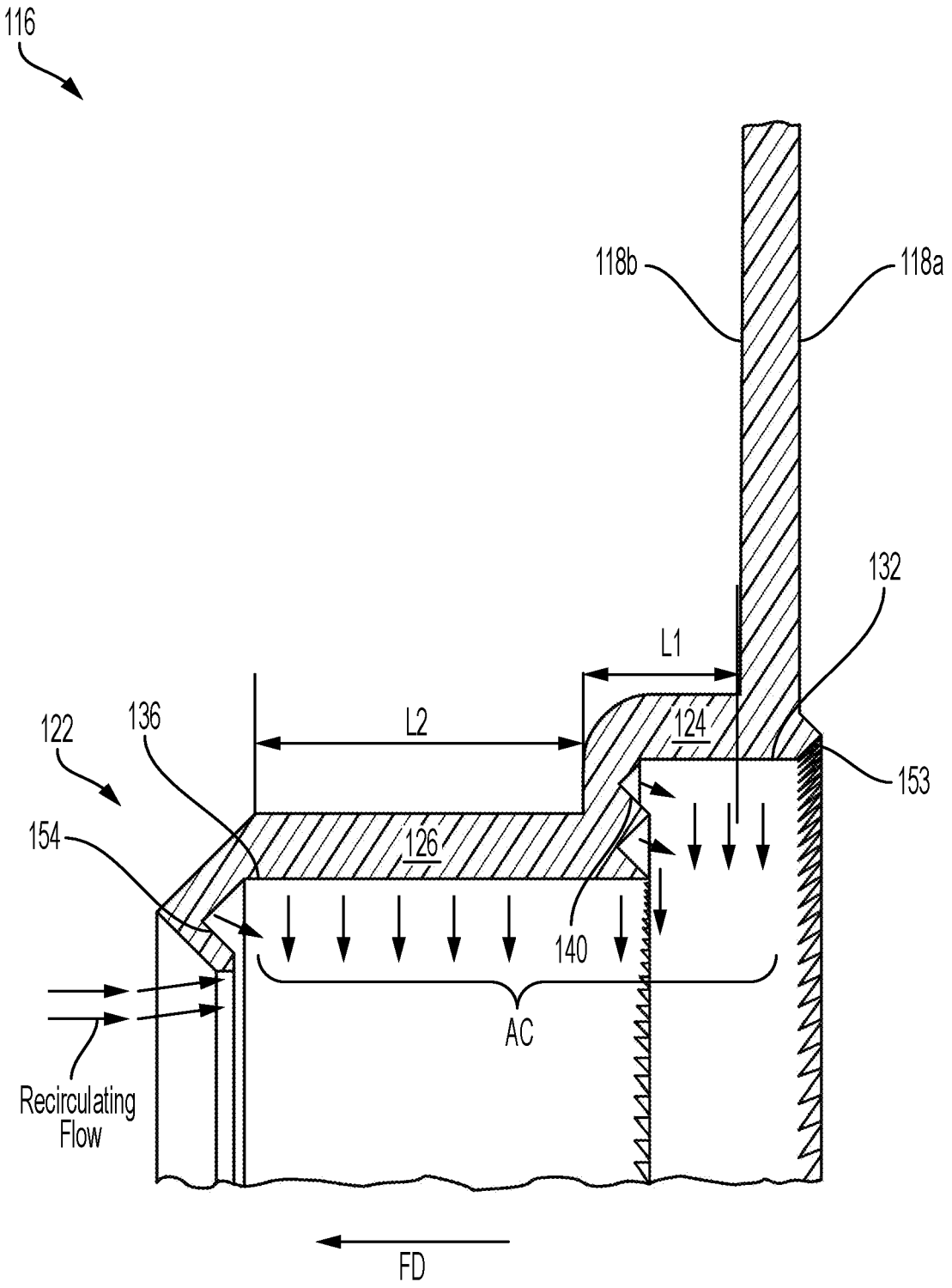
FIG. 4B illustrates a partial-cross-sectional view of a portion of the shroud as well as redirected recirculating air.
Figure 5:
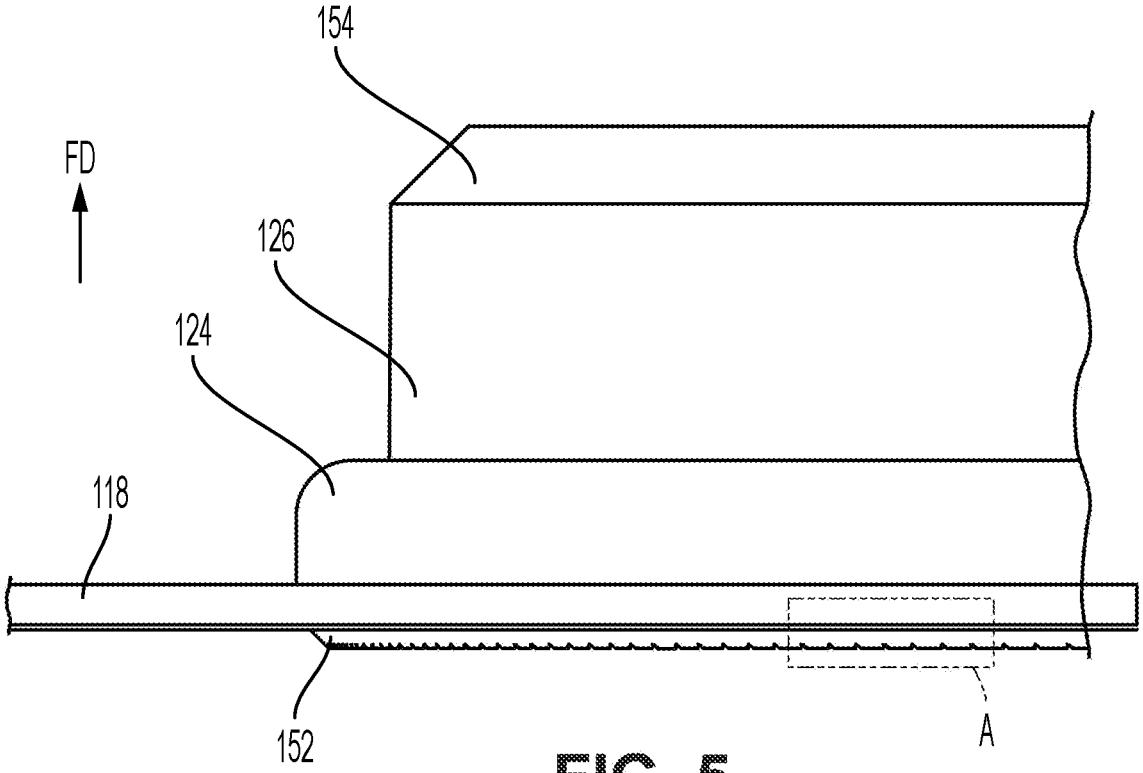
FIG. 5 illustrates a partial-top view of the shroud.
Figure 5A:
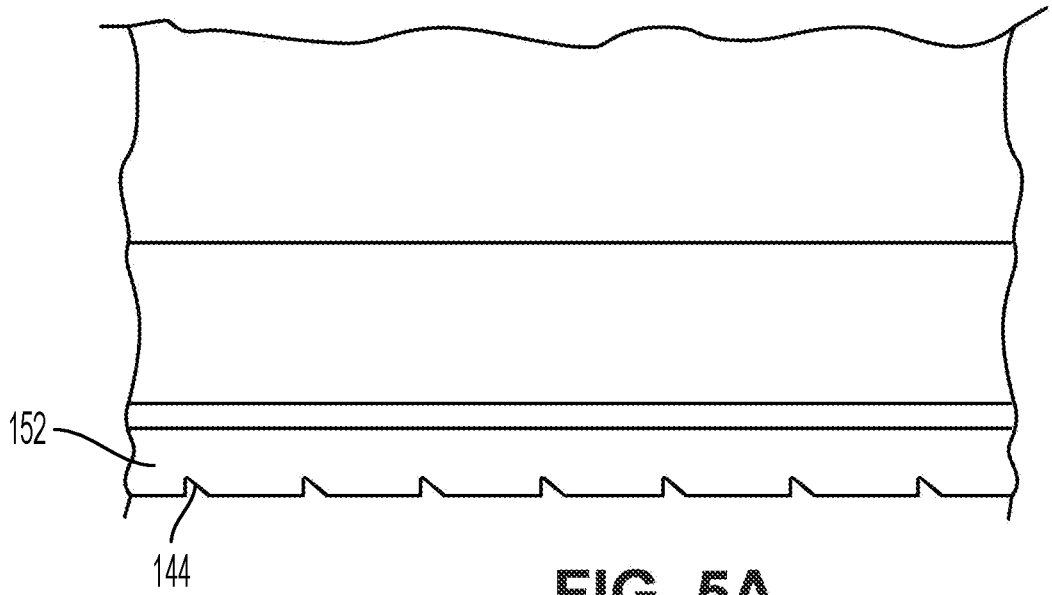
FIG. 5A illustrates a detailed view taken along the lines A in FIG. 5.

FIG. 4A depicts a partial-cross sectional view of the shroud 116 and fan assembly 102. The directional arrows indicate the direction and route that recirculating air flow travels from the downstream side of the fan assembly 102. FIG. 4B depicts how the barrel 122 and, in particular, the serrations 132, 136, 140, 150 are configured to prevent the recirculating airflow from traveling from the downstream side to the upstream side of the fan assembly 102.

In one or more embodiments, the first ring 124 and the second ring 126 may have different lengths. As an example, the first ring 124 may have a first length L1 and the second ring 126 may have a second length L2, and the second length may be greater than the first length L1. As mentioned above, during operation, the fan assembly 102 increases air pressure at the downstream side of the fan assembly 102. Portions of the fan assembly 102 disclosed nearest to the barrel 122, such as the first and second legs 110, 112 as well as the first and second radial serrations 132, 136 and the first and second axial serrations 140, 150 may be collectively configured to form an airflow passage in which the recirculating flow travels through. As one example, the first and second radial serrations 132, 136 and the first and second axial serrations 140, 150 may be collectively configured to redirect airflow in a direction substantially orthogonal to the flow direction FD to form an air current, as represented by the group of directional arrows labeled AC. The air current AC may be configured to block or mitigate recirculating flow from moving against the flow direction FD. As an example, the air current AC may redirect the circulating flow towards the first and second legs 110, 112 of the fan ring 108, which is not illustrated in FIG. 4B for the purposes of clarity. Alternatively or additionally, first and second radial serrations 132, 136 and the first and second axial serrations 140, 150 may create vortexes (FIGS. 6-7) configured to reduce the cross-sectional area of the airflow passage, to reduce the flow rate of the recirculating air. The ability block or inhibit the recirculating flow has been shown to increase airflow efficiency by approximately 2%. What is more, this configuration has been shown to reduce overall fan noise by up to 2 dBA.

In one or more embodiments, one or more portions of the barrel 122, such as the first ring 124, may include a first frustonical portion 152 that may extend from the first side 118*a* of the sidewall 118. The first number of radial serrations 132 may extend from the inner periphery 130 of the first ring 124 through the first frustoconical portion 152 and terminating at an end face 153. The end face 153 may extend in a direction oblique to the first side 118*a* of the sidewall 118. Alternatively or additionally, the barrel 122 may include a second frustoconical portion 154. The second frustoconical portion 154 may extend from or form a portion of the second ring 126. The first frustoconical portion 152 may be tapered in a direction opposing the flow direction FD in order to trap or block recirculating airflow from moving against the flow direction FD and the second frustoconical portion 154 may be tapered with respect to the flow direction FD to funnel the air flow thereby mitigating recirculating airflow from moving against the flow direction FD.

Figure 6:
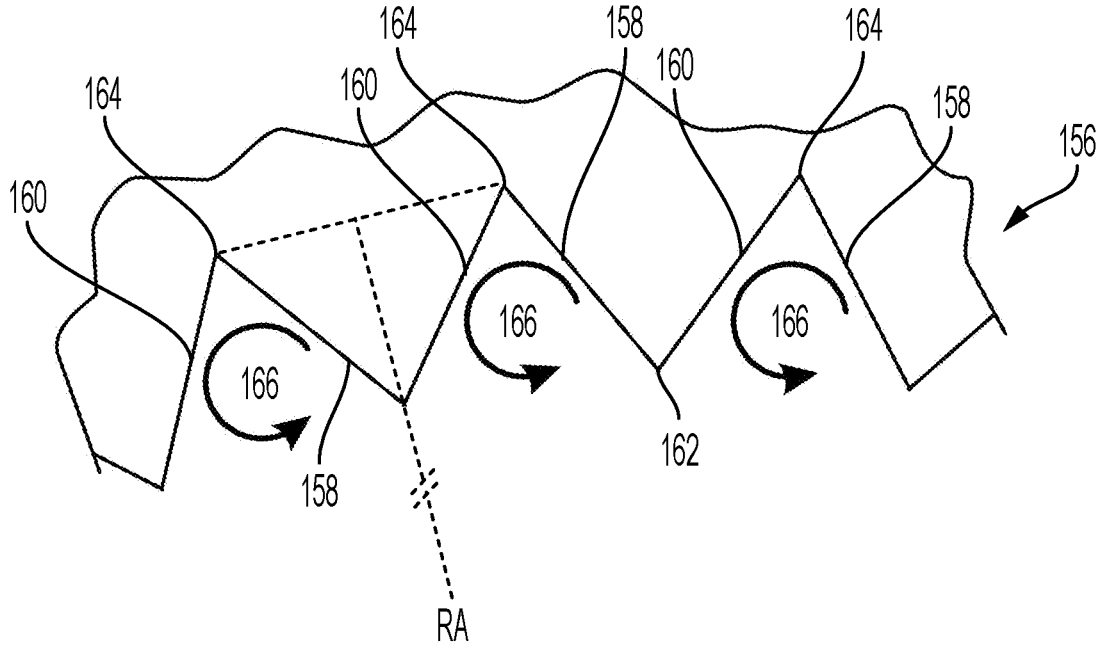
FIG. 6 illustrates a schematic view of one or more exemplary serrations or surface discontinuities formed in the barrel of the fan shroud.
Figure 7:
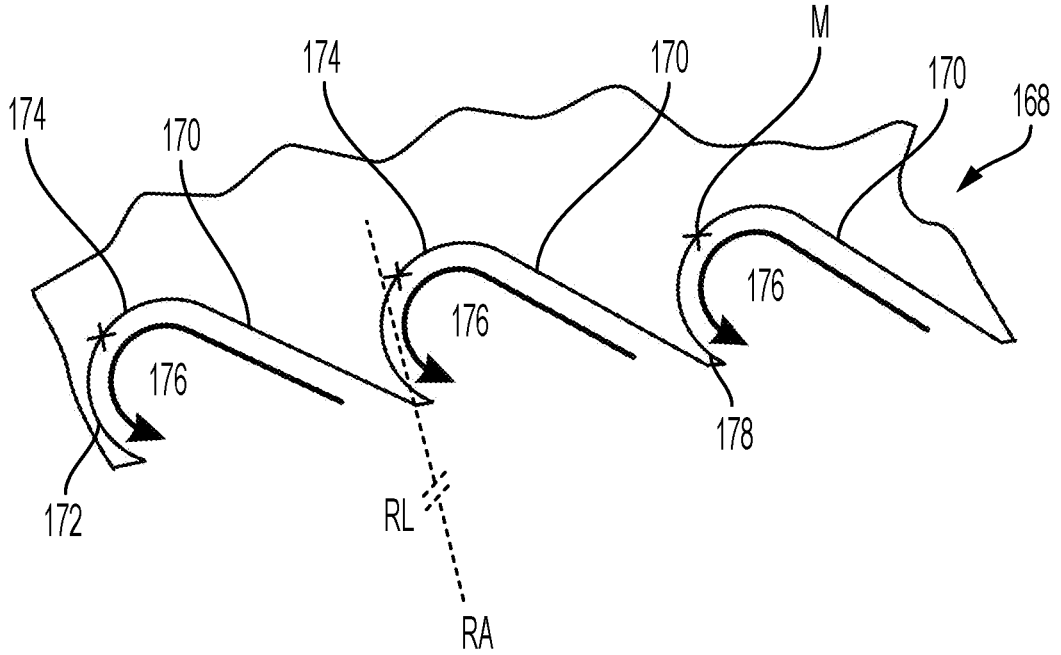
FIG. 7 illustrates a schematic view of one or more exemplary serrations or surface discontinuities formed in the barrel of the fan shroud.

FIG. 6 illustrates a partial-schematic-plan view of a portion of a number of surface discontinuities according to at least one embodiment and FIG. 7 illustrates a partial-schematic-plan view of a portion of a number of surface discontinuities according to at least one other embodiment. The number of surface discontinuities may be formed by symmetrical serrations 156, while in other embodiments, the number of surface discontinuities may be formed by non-symmetrical serrations 168. The symmetrical serrations 156 may be symmetrical with respect to the truncated radial line RL extending from the rotational axis RA, whereas, the non-symmetrical serrations may not be symmetrical with respect to the truncated radial line RL.

The symmetrical serrations 156 may each include first and second flanks 158, 160 that may extend from recesses 164 and converge at a peak 162. The flanks 158, 160 may be configured to generate turbulent airflow 166 to generate the air curtain AC and/or vortexes to reduce recirculating flow as described above. The non-symmetrical serrations 168 may include first and second flanks 170, 172 that may extend from a curved base 174 to a peak 178. In one or more embodiments, a midpoint M of the base may be offset or biased towards one of the flanks. This offset configuration may provide another turbulent airflow 176 which may be stronger than the turbulent air flow 166.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

PARTS LIST heat exchanger 10
impediment 12
cooling fan module 100
fan assembly 102
electric motor 103
fan blades 104
support a motor mounting ring 105
hub 106
struts 107
fan ring 108
first leg 110
second leg 112
curved portion 114
shroud 116
first sidewall 118
opening 120
barrel 122
first ring 124
second ring 126
connecting portion 128
first inner peripheral surface 130
first number of radial serrations, first number of surface discontinuities 132
second inner peripheral surface 134
second number of radial serrations, second number of surface discontinuities 136
axial face 138
first number of axial serrations, third number of surface discontinuities 140
peak 142
recesses 144
inner axial edge of second ring 146
inner axial recess of second ring 148
second number of axial serrations, fourth number of surface discontinuities 150
first frustoconical portion 152
end face 153
second frustoconical portion 154
symmetrical serrations 156
first flank 158
second flank 160
peak 162
recess 164
first turbulent air flow 166
non-symmetrical serrations 168
first flank 170
second flank 172
base 174
turbulent flow 176
peak 178

What is claimed is:

1. A cooling fan module comprising:

a fan assembly including a number of fan blades; and a shroud having an upstream side and a downstream side, wherein the fan assembly is arranged to move air from the upstream side to the downstream side, wherein the shroud includes, a first sidewall defining an opening, a first ring extending in an axial direction from the first sidewall and including an axial face, the axial face of the first ring including a number of first axial serrations, the number of first axial serrations extending in a radial direction, the radial direction substantially orthogonal to the axial direction, so that a peak of each serration of the number of first axial serrations faces the upstream side of the shroud and surrounds the opening.

2. The cooling fan module of claim 1, wherein the first ring includes a first portion and a second portion, the first portion at least partially extending from a first side of the first sidewall towards the upstream side, the second portion at least partially extending from a second side of the first sidewall towards the downstream side and terminating at the axial face.

3. The cooling fan module of claim 2, wherein the first ring includes a second sidewall extending substantially parallel to the first sidewall, the second sidewall including the axial face.

4. The cooling fan module of claim 3, wherein the shroud includes a second ring extending from the second sidewall and away from the upstream side of the shroud, a distal end portion of the second ring provided with a number of second axial serrations.

5. The cooling fan module of claim 3, wherein the first ring includes a number of first radial serrations axially extending along a circumferential inner periphery of the first ring.

6. The cooling fan module of 3, wherein the shroud includes a second ring extending from the second sidewall and away from the upstream side of the shroud, the second ring including a number of second radial serrations extending along a circumferential inner periphery of the second ring.

7. The cooling fan module of claim 1, wherein at least one serration of the number of first axial serrations is a triangular prism.

8. A shroud for use in a cooling fan module, the shroud comprising:

a sidewall defining an opening configured to receive a fan assembly and a motor, the motor configured to rotate the fan assembly to route air from an upstream side of the sidewall to a downstream side of the sidewall; and a barrel extending from the sidewall and forming an inner periphery of the opening, the barrel including, a number of first radial serrations, and a number of second radial serrations, the number of second radial serrations radially and axially spaced apart from the number of first radial serrations.

9. The shroud of claim 8, wherein the number of first radial serrations have a first length and the number of second radial serrations have a second length, the second length greater than the first length.

10. The shroud of claim 8, wherein the number of first radial serrations extend in an axial direction, the axial direction substantially orthogonal to the sidewall.

11. The shroud of claim 10, wherein the number of first radial serrations are positioned parallel to the number of second radial serrations.

12. The shroud of claim 11, wherein the number of first radial serrations includes a first proximal end and a first distal end, the distal end positioned further away, with respect to the axial direction, from the sidewall than the proximal end, the number of second radial serrations including a second proximal end and a second distal end, the second distal end positioned further away from the sidewall than the second proximal end, the second proximal end axially overlapping the first proximal end.

13. The shroud of claim 8, wherein the sidewall extends in a vertical direction, and each serration of the number of first radial serrations includes an axial face, the axial face extending along a direction oblique to the vertical direction.

14. The shroud of claim 8, wherein the barrel extends from the sidewall in an axial direction, and wherein the number of first radial serrations are axially spaced apart from the number of second radial.

15. A cooling fan module assembly comprising:

a fan assembly;

a motor coupled to the fan assembly; and a shroud including a sidewall defining an aperture configured to receive the fan assembly, the motor configured to rotate the fan assembly to route air from an upstream side of the shroud to a downstream side of the shroud, the shroud including a barrel extending from the sidewall, the barrel tapering from the upstream side to the downstream side, the barrel including:

a first ring extending from the sidewall in an axial direction, and a second ring arranged coaxially with respect to the first ring, the first ring including a first inner peripheral surface, and the second ring including a second inner peripheral surface, the first and second inner peripheral surfaces each including a number of surface discontinuities, the number of surface discontinuities collectively configured to generate turbulent airflow within the barrel to mitigate air flow from moving from the downstream side to the upstream side, wherein the number of surface discontinuities includes a number of peaks and a number of recesses, each recess of the number of recesses interstitially disposed between two peaks of the number of peaks, wherein at least some peaks of the number of surface discontinuities of the first inner peripheral surface and at least some peaks of the number of surface discontinuities of the second inner peripheral surface are each arranged to face towards a radial direction, wherein the radial direction is substantially orthogonal to the axial direction.

16. The cooling fan module assembly of claim 15, wherein a peak of the number of peaks includes a first flank and a second flank, the first flank is substantially straight and the second flank is curved from the peak towards an apex of a first recess of the number of recesses.

17. The cooling fan module assembly of claim 15, wherein the first ring includes a first frustoconical portion and a non-tapered portion, the first frustoconical portion extending away from the downstream side of the shroud, an inner periphery of the first frustoconical portion and the non-tapered portion including a first portion of the number of surface discontinuities.

18. The cooling fan module assembly of claim 17, wherein the barrel further includes, a second frustoconical portion extending from the second ring, the first frustoconical portion tapering in a first direction, the second frustoconical portion tapering in a second direction, the second direction opposing the first direction.

19. The cooling fan module assembly of claim 17, wherein the barrel further includes, a connecting portion extending between the first ring and the second ring, the connecting portion including an axial face provided with a second portion of the number of surface discontinuities.

20. The cooling fan module assembly of claim 18, wherein an inner periphery of the second ring includes a third portion of the number of surface discontinuities.

* * * * *